US005752386A

United States Patent [19]

Norberg et al.

[11] Patent Number: 5,752,386

[45] Date of Patent: May 19, 1998

[54] METHOD OF DRAINING A TANK AND A PLANT FOR USE IN SUCH DRAINING

[76] Inventors: Bård Norberg, Damveien 46, N-3121 Tønsberg; Jørn M. Jonas, Fiskeriveien, 19 3132 Husøysund; Einar Brendeng, Buggs vei 10, 7016 Trondheim, all of Norway

[21] Appl. No.: 700,500

[22] PCT Filed: Dec. 30, 1994

[86] PCT No.: PCT/NO94/00215

§ 371 Date: Dec. 31, 1996

§ 102(e) Date: Dec. 31, 1996

[87] PCT Pub. No.: WO96/21121

PCT Pub. Date: Jul. 11, 1996

[51] Int. Cl.[6] ..... F17C 1/00

[52] U.S. Cl. ..... 62/45.1; 62/614; 62/616

[58] Field of Search ..... 62/47.1, 45.1, 62/616, 614

[56] References Cited

U.S. PATENT DOCUMENTS

| | | | |
|---|---|---|---|
| 3,214,927 | 11/1965 | Bengtsson | 62/45.1 |
| 3,216,211 | 11/1965 | Pauliukonis | 62/45.1 |
| 3,699,696 | 10/1972 | Rhoton | 62/45.1 |
| 3,965,689 | 6/1976 | Brown et al. | 62/48.1 |
| 5,005,362 | 4/1991 | Weltmer, Jr. et al. | 62/45.1 |
| 5,367,881 | 11/1994 | Henzler | 62/616 |

FOREIGN PATENT DOCUMENTS

4306064 A1 9/1994 Germany .

*Primary Examiner*—Ronald C. Capossela

*Attorney, Agent, or Firm*—Sterne, Kessler, Goldstein & Fox P.L.L.C.

[57] ABSTRACT

A method of draining a tank that has been containing liquid gas, and a plant for use in such draining. After draining of the major part of the tank contents, but while residual contents of gas are present in vapourized state in the tank, the residual contents are conveyed for exchanging heat directly or indirectly with cold nitrogen. Nitrogen is vapourized and heated and conveyed to the tank, while the residual gas is cooled and condensed and conveyed to a collector tank. The plant comprises a heat exchange system connected to the supply of nitrogen, and residual gas is forced from the tank to be drained and through the heat exchange system in order to cause vapourization and heating of nitrogen to be conveyed to the tank, in such a manner that the residual gas from the tank condenses, whereby a collector container is connected for receiving condensed residual gas. In order to prevent that the residual gas freezes during the exchange of heat a cooling agent can be used which causes vapourization and heating of the nitrogen and which also is used for condensing the residual gas, without cooling the latter to below its freezing point.

12 Claims, 2 Drawing Sheets

METHOD OF DRAINING A TANK AND A PLANT FOR USE IN SUCH DRAINING

The present invention relates to a method of draining a tank containing a vapourized gas—after draining of its contents of liquified gas—by supplying to the tank vapourized nitrogen which is stored in liquid state in a supply. Moreover, the invention relates to a plant for use in draining of such a tank, comprising a supply of liquid nitrogen to be supplied to the tank in vapourized state.

Nitrogen is supplied in order to remove residues of combustible gases in tanks, and also in order to prevent the tanks in containing a mixture of different gases when one type of gas is to replace another type. Vapourized nitrogen, thus, is supplied to the tanks after substantially draining their contents of liquid gas, in order to expel the residues of the vapourized gases present in the tanks. The residual gases may be burnt or discharged into the atmosphere. Thereby a contamination takes place, because of the combustion or because the gases as such are contaminating. Moreover, a not insignificant amount of residual gas is lost each time this is carried out, which has been accepted as unavoidable.

Another aspect of flushing tanks with nitrogen is that the nitrogen is stored in liquid state, resulting in consumption of heat for vapourization of the nitrogen prior to supplying it to the tanks. The surrounding air may indeed be used as a heat emitting medium for the vapourization, but thereby the large cooling capacity of the liquid nitrogen is not utilized for anything else than cooling the air which causes the vapourization.

According to the present invention a method and a plant have been provided which at the same time permit recovery of the contents of residual gases in vapourized state in tanks whose contents of liquid gas have been drained and vapourization of liquid nitrogen to be supplied to the tanks by utilization of the heat in the residual gases.

The method and plant according to the invention appear from the succeeding claims.

According to the invention residual gases in vapourized state are expelled from an incompletely drained tank, in order to undergo heat exchange with liquid nitrogen to be supplied to the tank. The heat of the vapourized residual gases is utilized for vapourization of the nitrogen, and the residual gases can be condensed into liquid state in order to be recovered.

The invention may be utilized in landbased as well as in floating plants, for tanks on vehicles (trucks, railway), gas carrier ships, stationary onshore and offshore plants. In all cases is achieved that discharge of residual gases to the atmosphere or the development of combustion gases by combustion of the residual gases is avoided.

For all of the most common gases transported in liquid state the boiling point is substantially higher than that of nitrogen, whose boiling point is −197° C. (at atmospheric pressure), and when the residual gases are at their boiling point a large temperature difference will occur during the exchange of heat. The residual contents in a tank after incomplete drainage may for instance have the following temperature, depending on the type of gas: ethylene −100° C., ethane −80° C., propylene −45°/−20° C., propane −40°/−20° C., $NH_3$−33° C., butadiene and butylene +1° C., butane −3° C., i.e. slightly higher than the boiling point at atmospheric pressure. The residual contents of such gases in a tank after a usual (incomplete) drainage may be estimated as follows, when the volume of the tank is 6500 $m^3$: ethylene 17000 kg, ethane 19500 kg, propylene 17000/42500 kg, propane 17000/35500 kg, $NH_3$ 5700 kg, butadiene 18500 kg, butylene 20800 kg and butane 19500 kg.

The plant may of course have several recovery tanks, at least one for each type of residual gas to be collected.

The heat exchange may take place in two steps. Residual gas supplied from the tank which is incompletely drained can be conveyed to a first heat exchanger or a group of heat exchangers, in which exchange of heat takes place between vapourized, cold nitrogen gas from a storage tank and the residual gas, and the nitrogen gas is conveyed to the incompletely drained tank. The residual gas, which does not necessarily have to condense, can be conveyed for condensation in a separate circuit inside the nitrogen storage tank. This condensation will cause that nitrogen is vapourized and expelled from the storage tank and into the first heat exchanger. The exchange of heat in the storage tank can be carried out in such a manner that only a suitable degree of supercooling of the condensate takes place.

Because the nitrogen temperature in the heat exchangers for nitrogen and residual gas is lower than the freezing point of the residual gas, freezing-up problems can arise in the heat exchangers. This problem can be avoided by interposing a cooling agent system between condensing residual gas and vapourizing nitrogen, so that no direct heat exchange takes place between nitrogen and residual gas. The cooling agent system keeps the temperature of the vapourized nitrogen below the freezing point of the residual gas, while the cooling agent is kept above the freezing point of the residual gas. Such a system may for instance work with propane. Among other mediums which can be used are mentioned propene, ethane, mixtures of hydrocarbons and halocarbon R13. The cooling agent, in liquid state, is circulated by pumps, for exchange of heat with the nitrogen and the residual gas, respectively. The exchange of heat with the nitrogen may take place in two auxiliary heat exchangers. The cooling agent is pumped through a first auxiliary heat exchanger which causes vapourization of nitrogen. In a nitrogen tank surrounding this first auxiliary heat exchanger the nitrogen is kept at such a high pressure, and a correspondingly high temperature, that the cooling agent does not freeze, but the temperature may be lower than the freezing point of the residual gas. Another pump pumps the cooling agent through the residual gas condenser, whereupon the agent is conveyed for heat exchange with the nitrogen vapour in a second auxiliary heat exchanger, in order to adjust the temperature of the nitrogen vapour prior to conveying it to the heat exchanger for cooling of residual gas supplied from the tank to be drained. Thus, the agent in the cooling agent system, being kept at a higher temperature than the freezing point of the residual gas, is utilized for condensation of the residual gas. This is achieved by a control valve. The heating of the nitrogen can be adjusted by adjustment of the flow of the liquid cooling agent through the second auxiliary heat exchanger. The system may comprise indicators and controllers which permit adaption of the temperatures to different types of residual gases having different freezing points.

The invention will be explained more detailed in the following, with reference to the accompanying drawings, which diagrammatically show two examples of plants according to the invention.

Figure 1:
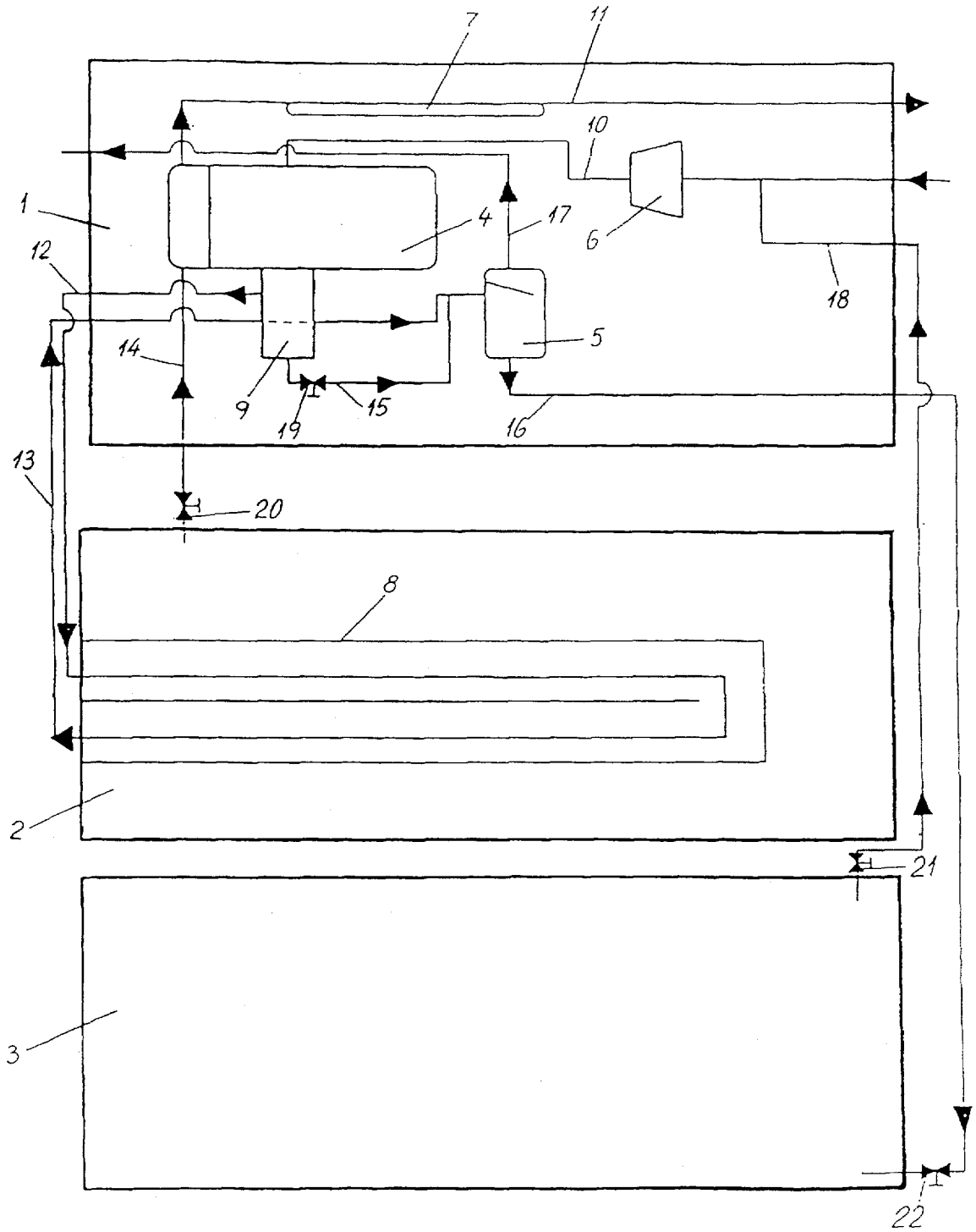
FIG. 1 shows a first embodiment, which is solely based on exchange of heat between nitrogen vapour and residual gas.

The plant shown in FIG. 1 comprises three main units; a recovery unit 1, in which residual gas and nitrogen are subjected to exchange of heat and separation, an insulated tank 2 having a heat exchanger (condenser) in a supply of liquid nitrogen and an insulated tank 3 for receiving recondensed residual gas.

From the tank (not shown) having been incompletely drained of its contents of liquid gas and containing a residual gas in vapour state, the residual gas is conveyed into the recovery unit 1 through a conduit 10. In the conduit 10 is shown a fan 6, for pumping of the residual gas. The residual gas is conveyed to a heat exchanger 4, to which also vapourized, cold nitrogen from the tank 2 is supplied via a conduit 14. Nitrogen in vapour state from the heat exchanger 4 passes a heater 7, whereupon it is conveyed into the tank containing residual gas, via a conduit 11. In the first phase nitrogen and residual gas in the tank will be stratified. The nitrogen will act to force residual gas out of the tank and into the recovery unit 1. The fan 6 may in the principle be omitted, but it will accelerate the transport of residual gas to the plant. The heat exchanger 4 may for instance be a tube heat exchanger of a known type.

Below the heat exchanger 4 is mounted a collector 9, which receives condensed residual gas and uncondensed residual gas having an increasing amount of nitrogen gas. The condensed residual gas is conveyed further to a separator 5, from which the condensed residual gas is transported through a conduit 16 to the collector tank 3.

Moreover, the collector 9 is connected to a condenser 8 for the residual gas. The uncondensed residual gas and the nitrogen present is conveyed from the collector 9 through the condenser 8, where an almost complete condensation and supercooling of the residual gas takes place. The supercooled residual gas and the nitrogen present is conveyed through the conduit 13 to the separator 5. The nitrogen is discharged from the separator, and the condensed residual gas is conveyed through the conduit 16 to the collector tank 3.

Moreover, the collector tank 3 for condensed residual gas is connected to the conduit 10 for incoming residual gas to the plant, through a conduit 18. Overpressure in the collector tank 3 will cause recirculation of residual gas.

The plant may comprise shut-off valves, being shown in the drawing as a valve 19 in the conduit 15, a valve 20 in the conduit 14, a valve 21 in the conduit 18 and a valve 22 in the conduit 16. Of course additional valves may be included, for instance safety valves.

The plant may be designed for, but is not limited to, all types of liquified gases having a gas pressure of more than 2,8 kp/cm$^2$ (abs.) at a temperature of 37,8° C. The plant can only be utilized With one residual gas at a time. If the plant is to be utilized with plural types of residual gases, the residual gas side of the plant has to be flushed with nitrogen gas prior to admitting another type of gas. Moreover, another collector tank must be connected.

Of course, the plant comprises, in addition to valves, (not shown) sensors and controllers.

When residual gas in vapour state, for instance ethylene at a temperature of approx. −100° C., is conveyed to the heat exchanger 4 and cold nitrogen gas at approx. −190° C. is simultaneously supplied to the heat exchanger 4 from the storage tank 2, the residual gas is cooled, but the nitrogen is heated further prior to flowing to the tank to be drained. A further heating is in some cases desired in order to achieve a favourable stratification of nitrogen and residual gas in the tank to be drained.

The nitrogen will force the residual gas from the tank to the plant, possibly aided by the fan 6. After some time from the starting of the plant a mixture of residual gas and nitrogen will flow in the conduit 10. On the residual gas side of the heat exchanger 4 the separator 5, therefore, is connected, in order that the nitrogen accompanying the condensed residual gas be separated and discharged through the conduit 17. The condensate of residual gas is conveyed from the separator 5 to the collector tank 3. The uncondensed residual gases in the collector 9 and the accompanying nitrogen are conveyed to the condenser 8 situated in the nitrogen storage tank 2. Provisions may be made in order that the condensate of residual gas be only supercooled to a limited degree, i.e. that the cooling does not proceed until the condensate is in the vicinity of the temperature of the liquid nitrogen. The accompanying nitrogen will still be in gaseous state. From the condenser 8 the condensate of residual gas and the nitrogen present are conveyed to the separator 5, where the condensate is mixed with condensate coming directly from the collector 9. The nitrogen is separated and discharged through the conduit 17.

The result, thus, is that the residual gas can be recovered almost completely. The residual gas in tanks which have been incompletely drained may comprise in the order of 1% of the contents of the tank when filled. Thus, the quantities of residual gas in question which can be recovered are large. In addition to the contamination which is avoided, residual gas representing a large value is collected.

Another example of a plant according to the invention, including a system with heat exchange by use of a cooling agent, is explained in the following, with reference to FIG. 2. The same reference numerals as in FIG. 1 are used for elements being similar to or equivalent with elements in FIG. 1. A system is described which uses propane as cooling agent.

A first auxiliary heat exchanger 30, in the form of a set of tubes for propane, is mounted in a nitrogen tank 2 to which nitrogen is supplied from a supply (not shown) through a valve 52, the propane being forced by a pump 31, through tubes 32, 33. A valve 40 keeps the nitrogen at such a high pressure in the tank 2 that the propane does not freeze. The pressure may for instance be approx. 2,8 kp/cm$^2$ (abs.). A second pump 35 brings the propane through the residual gas condenser 8, via tubes 36 and 37. A valve 38, controlled by a regulator 44, controls the propane temperature in such a manner that it is somewhat higher than the freezing point of the residual gas supplied to the condenser 8. The nitrogen vapour flowing from the tank 2 to the heat exchanger 4 is directed through a second auxiliary heat exchanger 39, through which also propane having passed through the condenser 8 flows, via tubes 41 and 42. Thereby the nitrogen vapour is heated prior to flowing to the heat exchanger 4 via the tube 14. Residual gas is supplied to the heat exchanger 4 through a conduit 10, which may be equipped with a valve 53. The degree of heating of the nitrogen vapour in the auxiliary heat exchanger 39, for accommodation to various types of residual gases, is controlled by a valve 43, which regulates the flow of propane through the auxiliary heat exchanger 39 in such a manner that the nitrogen vapour attains a somewhat higher temperature than the freezing point of the residual gas. The regulation during operation may take place automatically, in that temperature controllers 44 and 45 control the valves 38 and 43, and these controllers can be set somewhat higher than the freezing point of the residual gas.

Figure 2:
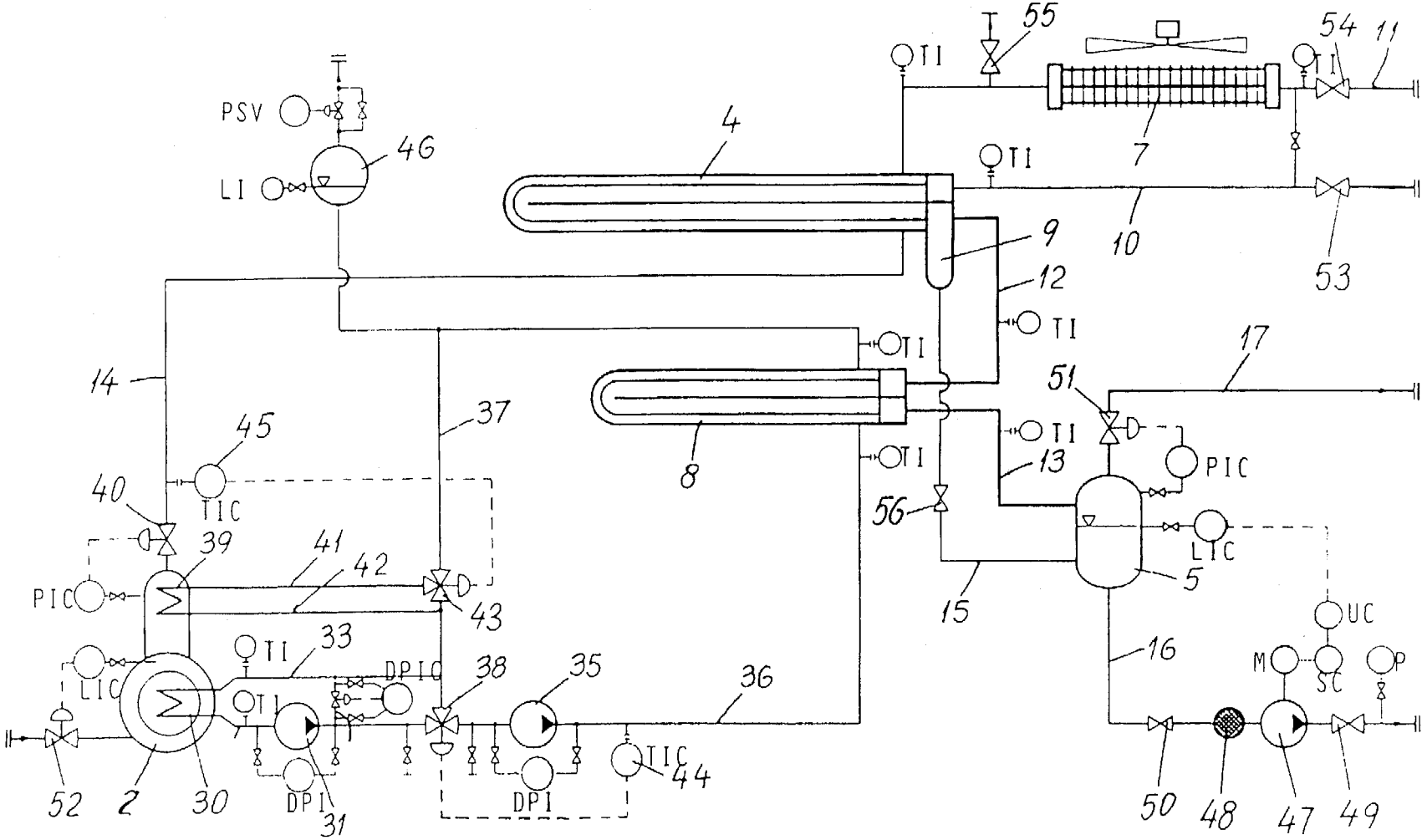
FIG. 2 shows a second embodiment, having a separate cooling agent system which prevents freezing of the residual gas.

FIG. 2 also shows a nitrogen heater 7 having a fan, for flow through of nitrogen vapour to be supplied to the tank to be drained, via a conduit 11. The conduit 11 may be equipped with a valve 54, and also a discharge valve 55 is shown. A conduit 12 conveys residual gas from the heat exchanger 4 to the condenser 8. The residual gas may be caused to condense by the pressure in the tank to be drained. This pressure is determined by the amount of nitrogen supplied to the tank. Also a pump may be used, if the tank to be drained cannot withstand the necessary inner pressure. Because residual gas and nitrogen are mixed in the tank to be drained, a nitrogen separator 5 is used, to which the residual gas is supplied via a conduit 13, and residues of nitrogen are discharged through a conduit 17, which is equipped with a controller valve 51, while condensed residual gas is conveyed to a collector tank (not shown) through a conduit 16 equipped with a pump 47, a filter 48 and valves 49 and 50. A condensate collector 9 is mounted in association with the heat exchanger 4 and receives partially condensed residual gas. Condensate of residual gas from the collector 9 is conveyed to the separator 5 via a conduit 15 equipped with a valve 56.

Moreover, the propane circuit is equipped with an expansion tank 46 for propane, in order to allow thermal expansion.

FIG. 2 also shows various auxiliary valves, indicators and controllers, having the following designations:

DPI: Pressure difference indicator.

LIC: Liquid level indicator and controller.

M: Servo motor.

P: Pressure gauge.

PSV: Safety valve.

PIC: Pressure indicator and controller.

SC: Speed controller.

TIC: Temperature indicator and controller.

TI: Temperature indicator.

UC: Level controller.

While residual gas flows from the tank to be drained through the conduit 10, nitrogen vapour flows to the tank through the conduit 11, after having passed the auxiliary heat exchanger 39, the heat exchanger 4 and the heater 7. The residual gas flows through the heat exchanger 4, the condenser 8 and the nitrogen separator 5, to a not shown collector tank. In the cooling agent system the liquid cooling agent flows in a circuit through the first auxiliary heat exchanger 30 and in a second circuit through the condenser 8 and thereupon to the second auxiliary heat exchanger 39. The indicators and the controllers make it possible to control the temperature of the nitrogen vapour in such a manner that the residual gas being cooled in the heat exchanger 4 and being condensed in the condenser 8 does not freeze, and the temperature can be adjusted in accordance with the type of residual gas.

We claim:

1. A method of draining a tank containing a vapourized residual gas—after draining said tank's contents of liquefied gas—by supplying to said tank vapourized nitrogen which is stored in liquid state in a supply, comprising:

condensing some of said vapourized residual gas by bringing said residual gas to a first exchange of heat with vapourized nitrogen;

conveying vapourized nitrogen to said tank, thereby forcing vapourized residual gas out of said tank;

condensing vapourized residual gas by a second direct or indirect exchange of heat with said liquid nitrogen in said supply, whereby nitrogen in said supply vapourizes and is used in said first exchange of heat;

conveying the condensed residual gas to a collector tank; and repeating the above steps until said tank is drained of vapourized residual gas.

2. A method of draining a tank containing a vapourized residual gas according to claim 1, wherein said vapourized nitrogen and incoming residual gas from said tank to be drained exchange heat in a heat exchange system outside the supply of nitrogen.

3. A method of draining a tank containing a vapourized residual gas according to claim 1, wherein said nitrogen from said supply is conveyed for exchanging heat with a cooling agent, which is conveyed for exchanging heat with said residual gas for condensation of said residual gas.

4. A method of draining a tank containing a vapourized residual gas according to claim 3, wherein said cooling agent after condensation of said residual gas is conveyed for exchanging heat with said vapourized nitrogen for heating of said vapourized nitrogen.

5. A plant for use in draining a tank containing a vapourized residual gas comprising:

a supply of liquid nitrogen to be supplied to said tank in a vapourized state;

a first part of a heat exchange system connected to said supply of nitrogen for vapourizing nitrogen and creating a forcing pressure in said supply which forces vapourized nitrogen to exit said first part;

a second part of said heat exchange system unconnected to said supply of nitrogen for receiving vapourized nitrogen from said first part via a conduit, wherein said vapourized nitrogen from said first part exchanges heat with residual gas from said tank within said second part, thereby cooling and/or condensing some of said residual gas, while the remaining vapourized residual gas is conveyed to said first part; and a collector container connected to said system via a conduit for receiving the condensed residual gas.

6. A plant for use in draining a tank containing a vapourized residual gas according to claim 5, wherein said condenser for residual gas is provided in said nitrogen supply.

7. A plant for use in draining a tank containing a vapourized residual gas according to claim 5, wherein said heat exchange system comprises a first auxiliary heat exchanger for receiving a liquid cooling agent in order to vapourize nitrogen, and said residual gas condenser is connected for receiving said cooling agent.

8. A plant for use in draining a tank containing a vapourized residual gas according to claim 7, further comprising a second auxiliary heat exchanger to which said cooling agent is supplied from said condenser is connected to said supply of nitrogen for heating of said nitrogen vapour conveyed to said residual gas heat exchanger.

9. A plant for use in draining a tank containing a vapourized residual gas according to claim 8, further comprising a temperature controlled valve for controlling the flow of said cooling agent through said second auxiliary heat exchanger.

10. A plant for use in draining a tank containing a vapourized residual gas according to claim 9, further comprising a temperature controlled valve for controlling the flow of cooling agent through said condenser.

11. A plant for use in draining a tank containing a vapourized residual gas according to claim 7, further comprising a temperature controlled valve for controlling the flow of cooling agent through said condenser.

12. A plant for use in draining a tank containing a vapourized residual gas according to claim 8, further comprising a temperature controlled valve for controlling the flow of cooling agent through said condenser.

* * * * *